United States Patent [19]

Stahl et al.

[11] 4,329,672

[45] May 11, 1982

[54] POLARIZED ELECTROMAGNETIC DRIVE FOR A LIMITED OPERATING RANGE OF A CONTROL ELEMENT

[75] Inventors: Heinz Stahl, Olpe; Harald Wagner, Kreuztal, both of Fed. Rep. of Germany

[73] Assignee: Elektro-Mechanik GmbH, Fed. Rep. of Germany

[21] Appl. No.: 96,248

[22] Filed: Nov. 20, 1979

Related U.S. Application Data

[63] Continuation of Ser. No. 872,382, Jan. 26, 1978, abandoned.

[30] Foreign Application Priority Data

Jan. 29, 1977 [DE] Fed. Rep. of Germany ..... 2703788
Jan. 29, 1977 [DE] Fed. Rep. of Germany ... 7702630[U]

[51] Int. Cl.³ ..... H01F 7/08

[52] U.S. Cl. ..... 335/229; 335/230; 310/36

[58] Field of Search ..... 310/36–39; 335/229, 230, 272

[56] References Cited

U.S. PATENT DOCUMENTS

| | | | |
|---|---|---|---|
| 2,930,945 | 3/1960 | Weathers et al. | 335/230 |
| 3,270,219 | 8/1966 | Trouilhet | 310/38 X |
| 4,135,119 | 1/1979 | Brosens | 310/36 X |

*Primary Examiner*—Donovan F. Duggan
*Attorney, Agent, or Firm*—McGlew and Tuttle

[57] ABSTRACT

A polarized electromagnetic drive preferably for actuating a turning servo valve comprises an electromagnetic field iron core which has a central open area and a core receiving recess defined in said core on each side of the open recess with a coil therein and with a rotatable armature drive shaft located in the open area of the core which has an armature affixed thereto with a pair of diametrically opposite radially extending arm portions. The core also has a leg portion which is spaced away from each side of the armature arm portions by an amount to define a large air gap between each side of each arm portion and each leg portion. Each of the leg portions has an end part extending outwardly from the associated leg portion and alongside the outer ends of the armature arm portions and spaced from the outer ends by an amount to define a small air gap between each end part and the associated outer end of the armature arm portions. The core has end pieces which extend outwardly from behind each leg portion on each side of the leg portions and which define a permanent magnet receiving recess therebetween alongside each leg portion on each side of the armature arm portions. A permanent magnet is disposed in the permanent magnet receiving recess and is opposed to and spaced from each end of each arm portion. The large and small air gaps which are formed between the armature and the field iron parts are such that the force components of the large and small air gaps result in a total force having a range of linearity which is greater than the range of linearity of the individual force components.

2 Claims, 3 Drawing Figures

POLARIZED ELECTROMAGNETIC DRIVE FOR A LIMITED OPERATING RANGE OF A CONTROL ELEMENT

This is a continuation of application Ser. No. 872,382 filed Jan. 26, 1978, now abandoned.

BACKGROUND OF THE INVENTION

1. Field of the Invention

The present invention relates in general to control drives and in particular to a new and useful polarized electromagnetic drive, preferably for actuating a turning servo valve.

2. Description of the Prior Art

The term "polarized electromagnetic drive" as used in the present application refers to an electromagnetic transducer for converting electric input signals supplied in the form of electric currents, into proportional mechanical output quantities, such as torque, force, angle of rotation, or displacement. Polarized electromagnetic drives, known as control or torque motors, may be used also for controlling servo valves. Usually, they operate through only a small angle of rotation or over a small distance, for example, within an angular range of up to about two degrees, thus within the range of proportionality between the output and input variables. With the angle of rotation exceeding about two degrees, the output quantity varies, relative to the input quantity and conditional upon the system, following an exponential function, so that in this range, there is no longer a proportionality between the input and output variables, wherefore this range, which extends over more than a half of the geometrically possible region, usually cannot be utilized. An extension of the angular range beyond about two degrees, while simultaneously preserving the proportionality between the input and output quantities and transmitting the same force or torque, may be obtained in electromagnetic drives of the prior art only by increasing the total volume.

SUMMARY OF THE INVENTION

The invention is directed to an electromagnetic drive mechanism which, with the same torque and same total volume, has a substantially larger angular range than presently known drives, and has input and output quantities which are proportional to each other.

In accordance with the invention, the field iron parts are provided, between the armature and the permanent magnets and radially opposite to the armature poles, with projections in a manner such that large and small air gaps are formed between the armature and the field iron parts, with the force components of the large and small air gaps resulting in a total force having a range of linearity which is greater than the range of linearity of the individual force components.

Accordingly it is an object of the invention to provide a polarized electromagnetic drive preferably for actuating a turning servo valve which comprises an electromagnetic field iron core which has a central opening area with a coil receiving recess defined in the core on each side of the open area and with an armature drive shaft rotatably mounted in the open area and having arm portions extending radially outwardly from each end and forming an armature which is spaced from leg portions of the core which are arranged on each side of each arm portion by an amount to define a large air gap between each side of each arm portion and the associated leg portion of the core and wherein the leg portion of the core has an end part which extends outwardly from the associated leg portion and alongside each respective outer end of each armature arm portion and spaced from the outer ends by an amount to define a small air gap between each end part and the associated outer end of the armature arm portion and wherein the core also has a recess on each end thereof which accommodates a permanent magnet arranged in spaced relationship to each outer end of each arm portion of the armature and wherein the large and small air gaps which are formed between the armature and the field iron parts have force components which result in a total force having a range of linearity which is greater than the range of linearity of of the individual force components produced in each of the large and small air gaps.

A further object of the invention is to provide a polarized electromagnetic drive which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

GENERAL DESCRIPTION OF THE PREFERRED EMBODIMENTS

Figure 1:
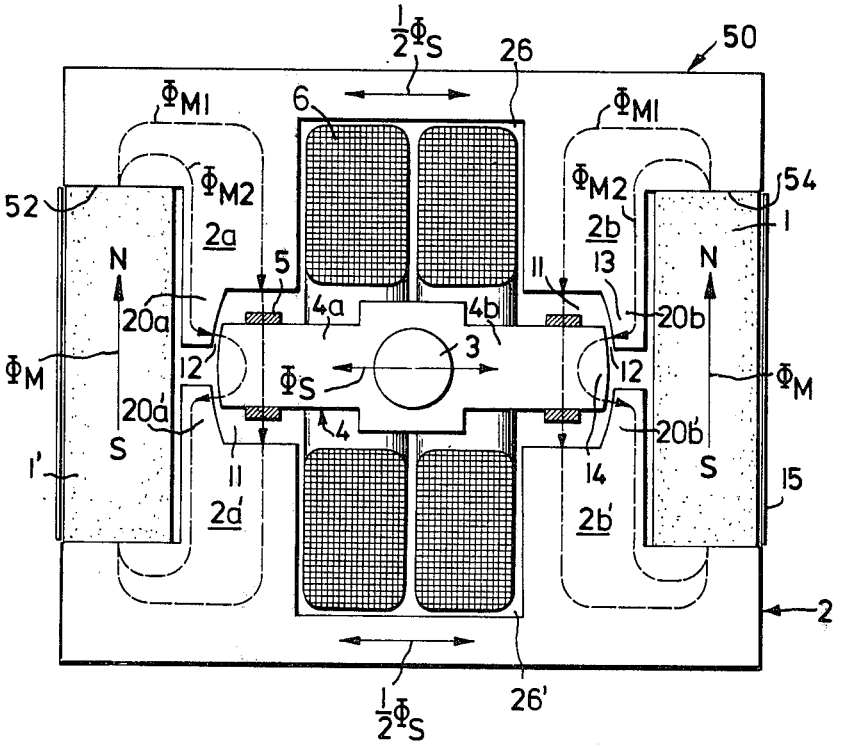
FIG. 1 is a schematic axial sectional view of an electromagnetic drive mechanism constructed in accordance with the invention.

Referring to the drawings in particular, the invention embodied therein comprises an electromagnetic drive generally designated 50 which includes a field iron core or part generally designated 2 having a central opened area 2*a* in which there is a rotatable drive shaft 3 of an armature generally designated 4 which includes leg portions 4*a* and 4*b* which extend outwardly from the shaft 3 in respective opposite diametric directions. On each side of the central open area 2*a* there is a coil receiving area 2*b* and 2*b*′ for receiving an armature coil 6.

In accordance with a feature of the invention the core 2 includes leg portions 2*a* and 2*b* which are spaced apart and which are arranged opposite to leg portions 2*a*′ and 2*b*′ on each side of the arm portions 4*a* and 4*b* of the armature 4. Leg portions 2*a* and 2*a*′ are spaced away from the associated arm 4*a* to define a large magnetic gap 11 therebetween and a similar large magnetic gap is formed between the arm portions 2*b* and 2*b*′ in the associated arm 4*b* of the armature at the opposite end. This large size gap 11 is distinct from a small size gap 12 which is defined from between each outer end of the arm portions 4*a* and 4*b* respectively in respective end parts 20*a* and 20*a*′ and 20*b* and 20*b*′ of the core 2 which extends around the ends of the respective arm portions.

The construction in addition includes a recess 52 and 54 defined in each end of the core 2 which accommodate respective permanent magnets 1 and 1'. The magnets 1 and 1' are arranged in opposition to the respective ends of the arm portions 4a and 4b of the armature 4.

Figure 2:
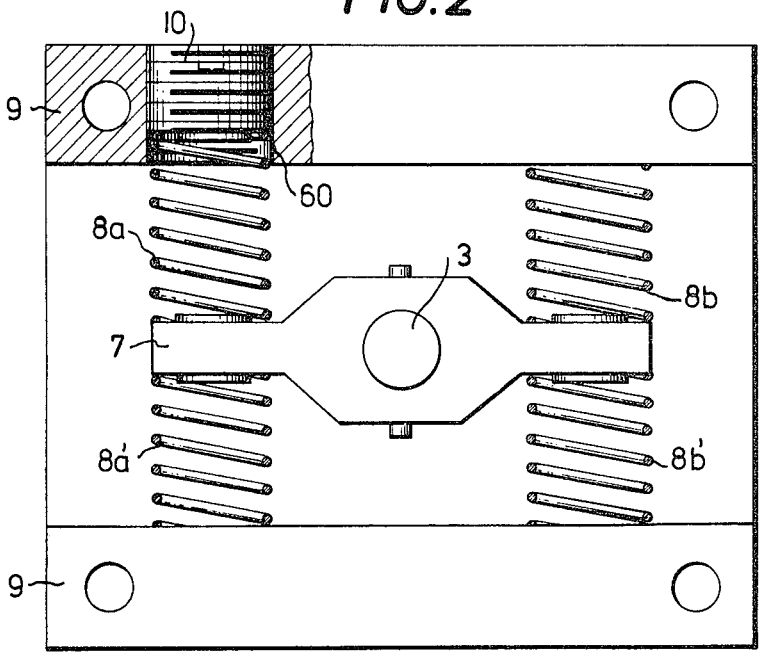
FIG. 2 is a view similar to FIG. 1 showing another sectional view and indicating a spring centering device for the armature.

As shown in FIG. 2 the shaft 3 also carries a lever arm member 7 similar in construction to the armature 3 which is held by sets of springs 8a and 8b which bear against the lever arm on one side of the shaft 3 and springs 8a' and 8b' which bear against the lever arm on the opposite side of the shaft 3 in order to bias the shaft into a central position. A zero adjusting screw 10 is threaded into a receiving bore 60 of the core piece 2 and it may be threadably adjusted in the bore in order to vary the zero setting of the shaft 3 and the associated armature 4.

FIG. 1 shows the permanent magnets 1 and 1' which are partly surrounded by two field iron parts 2. Drive shaft 3 carries armature 4 which is provided with damping turns 5. Between armature 4 and permanent magnets 1, radially opposite to the armature poles, field iron parts 2 are provided with projections 13 which form the respective end parts 20a and 20a' and 20b and 20b', so that both small air gaps 12 and large air gaps 11 are formed between armature 4 and field iron parts 2. The control coils 6 embrace armature 4 in the transverse direction.

A centering spring mechanism shown in FIG. 2 comprises a lever arm 7 affixed to the shaft 3, springs 8, spring receiving parts 9, and a zero point adjusting screw 10.

The inventive drive mechanism operates as follows.

The two permanent magnets 1 produce a magnetic flux $\phi_{M1}$ ($\phi$ stands for phi) in large air gaps 11, and a magnetic flux $\phi_{M2}$ in small air gaps 12. As soon as an electric current flows through control coils 6, a magnetic control flux $\phi_s$ is produced in armature 4. Magnetic control flux $\phi_s$ splits up to be effective across large air gaps 11 and small air gaps 12 in accordance with the magnetic resistances thereof and superimposes magnetic flux $\phi_M$1 in large air gaps 11 and magnetic flux $\phi_{M2}$ in small air gaps 12. The result of the superimposition of the magnetic fluxes is that a deflecting force is produced at armature 4 and, thereby, a deflecting torque which sets armature 4 in rotary motion until the countertorque produced by lever arm 7 and springs 8 of the centering spring mechanism becomes equal in amount but opposite in direction to the deflecting torque, whereby armature 4 is stopped. Within the limits set by the geometry of air gaps 11 and 12, the angle of rotation of armature 4 is proportional to the amount and direction of the current flowing through control coils 6.

The deflecting force acting on armature 4 is due, in large air gaps 11, to the difference of the attractive forces effective, in the direction of rotation at either side of the armature, between the parts facing each other and penetrated by the superimposed magnetic fluxes, namely the field iron parts 2 and the armature poles 14, and in the small air gap 12, to the dynamic effect of the magnetic fields which are perpendicular to each other, namely, in the present example, of the magnetic fluxes $\phi_{M2}$ crossing the small air gaps 12 and penetrating the armature poles 14 transversely, and the control flux $\phi_s$ which is directed perpendicularly thereto and depends on the current direction.

Figure 3:
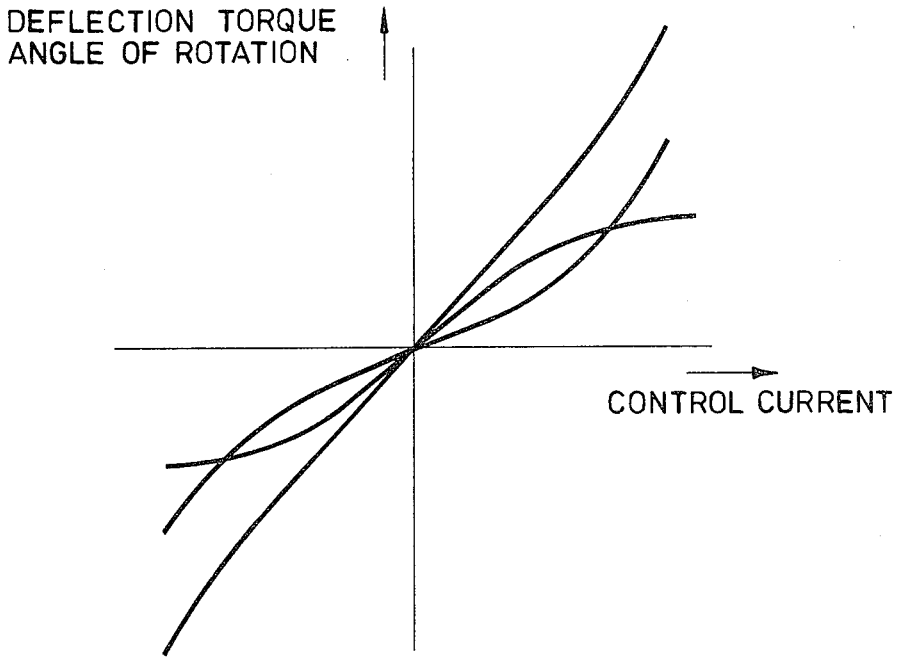
FIG. 3 is a diagram or curve indicating the deflecting torque or angle of rotation plotted against the control current.

The linear relationship between the control current flowing through coils 6 and the force deflecting armature 4 is due to an addition of the force components which are effective in equal directions in the large and small air gaps 11 and 12. The determining conditions being such that, within the small deflection range, the force components in both the large and small air gaps 11 and 12 are linearly proportional to the control current flowing through coils 6, while in the range of greater deflections, the forced component in the large air gaps 11 increases exponentially, because in the direction of rotary motion, the spacing between armature poles 14 and field iron parts 2 changes, namely at the leading side, the large air gaps 11 grow narrower and at the trailing side they grow larger, whereby in gaps 11, the superimposed magnetic fluxes increase at the leading side so that armature poles 14 and field iron parts 2 are correspondingly attracted to each other under more force, while at the same time, at the trailing side, due to the increasing magnetic resistance and, thereby, decrease of the superimposed magnetic fluxes, the attraction force is reduced which intensifies the exponential increase. On the other hand, due to the shape of the outer ends of armature poles 14 and the corresponding spaced shape of the end parts 20a, 20a', 20b, 20b', the widths of the small gaps 12 remain constant and are parallel to a surface of revolution about the axis of rotation. The force component in small air gaps 12, on the contrary, diminishes with larger deflections (FIG. 3) since the effective magnetic resistances of gaps 12 increase due to saturation phenomena, whereby the superimposed magnetic fluxes effective in these small gaps are reduced. The combined effect of the forces across large and small gaps 11 and 12 results in a substantially larger linear deflection range of armature 4, as compared to that of the individual force components (FIG. 3).

The moment of inertia of armature 4 and the centering spring mechanism form together a spring-mass system which is satisfactorily damped by damping turns or coils 5 provided on armature 4. A similar damping effect is obtained if damping coils 5 are provided in the coil space of field iron parts 2, or if control coils 6 themselves are short circuited directly or through an impedance network. The zero point of the drive mechanism may be varied by means of a zero point adjusting screw 10.

The steepness of the drive mechanism, i.e. the relationship between the angle of rotation of the armature and the control current, may be varied by means 15 which are disposed in front of permanent magnets 1 thereby forming a small magnetic shunt.

While specific embodiments of the invention have been shown and described in detail to illustrate the application of the principles of the invention, it will be understood that the invention may be embodied otherwise without departing from such principles.

What is claimed is:

1. A polarized electromagnetic drive preferably for actuating a turning servo valve, comprising an electromagnetic field iron core having a central open area and a coil receiving recess defined in said core on each side of said open area, a rotatable armature drive shaft located in the open area of said core for rotation about an axis of rotation, an armature affixed to said drive shaft for rotation therewith having a pair of diametrically opposed armature portions radially extending relative to the axis of rotation with inner ends affixed to said shaft and outer ends extending outwardly from said shaft on respective opposite sides thereof, an actuating coil disposed in said coil receiving recess, said core having a leg portion spaced away from each side of each arm portion by an amount to define a large air gap between each side of each arm portion and each leg portion of said core, each leg portion having an end part extending outwardly from the associated leg portion and alongside the outer ends of said armature arm portions and being radially spaced relative to the axis of rotation from said outer ends by an amount to define a small air gap between each end part and the associated outer ends of said armature arm portions, said core having end pieces extending outwardly beyond each leg portion on each side of said leg portions and having a permanent magnet receiving recess defined therebetween, a permanent magnet in the permanent magnet receiving recess opposed to and spaced from each end of each arm portion, each end part being located intermediate a respective permanent magnet and one of said outer ends of said armature arm portions, the large and small air gaps formed between said armature and said core being such that force components of the large and small air gaps result in a total force having a range of linearity which is greater than the range of linearity of the individual force components, a lever arm affixed to said shaft, and spring means for biasing said lever arm to a centering position, said lever arm including an arm portion extending outwardly from each side of said shaft, said spring means including first and second springs biased against each side of each portion of said lever arm, screw means associated with at least one of said springs for varying the tension on said springs for varying the positioning of the center position of said lever arm.

2. A polarized electromagnetic drive as set forth in claim 1, wherein each of said outer ends of said armature arm portions and said end part extending alongside of said respective outer end are shaped so that said small air gap has a constant width therebetween relative to the axis of rotation.

* * * * *